US010219575B2

(12) United States Patent
Stringfellow et al.

(10) Patent No.: US 10,219,575 B2
(45) Date of Patent: Mar. 5, 2019

(54) STRUCTURED MATERIAL FOR IMPACT PROTECTION

(71) Applicant: TIAX LLC, Lexington, MA (US)

(72) Inventors: Richard Stringfellow, Winchester, MA (US); Simona Socrate, Winchester, MA (US); Jacky Lau, Woburn, MA (US)

(73) Assignee: TIAX LLC, Lexington, MA (US)

( * ) Notice: Subject to any disclaimer, the term of this patent is extended or adjusted under 35 U.S.C. 154(b) by 1199 days.

(21) Appl. No.: 13/971,269

(22) Filed: Aug. 20, 2013

(65) Prior Publication Data

US 2015/0047113 A1 Feb. 19, 2015

Related U.S. Application Data

(60) Provisional application No. 61/866,807, filed on Aug. 16, 2013.

(51) Int. Cl.
*A42B 3/12* (2006.01)

(52) U.S. Cl.
CPC ..... *A42B 3/124* (2013.01); *Y10T 428/24149* (2015.01)

(58) Field of Classification Search
CPC ..... A42B 3/124
See application file for complete search history.

(56) References Cited

U.S. PATENT DOCUMENTS 3,251,076 A 5/1966 Burke
3,877,076 A * 4/1975 Summers ..... A42B 3/124 2/414
4,422,183 A * 12/1983 Landi ..... A41D 13/015 2/455
4,432,099 A * 2/1984 Grick ..... A42B 3/124 2/412

(Continued)

FOREIGN PATENT DOCUMENTS

WO 2012020066 A9 2/2012

OTHER PUBLICATIONS

Notification of Transmittal of the International Search Report and the Written Opinion of the International Searching Authority, or the DeclaratioPCT/US14/42241; dated Mar. 13, 2015; 16 pages.

*Primary Examiner* — Andrew W Sutton
(74) *Attorney, Agent, or Firm* — Cantor Colburn LLP

(57) ABSTRACT

A structured material for impact protection includes a plurality of tubular members formed from a thermoplastic elastomer material. The plurality of tubular members are arranged in a bundle such that the central axes of the plurality of tubular members are substantially parallel, and adjacent tubular members are secured to one another along their length. A method of forming a structured impact protection material includes arranging a plurality of tubes formed from a thermoplastic elastomer material into a selected shape. The tubes are arranged in a layer with central axes of the plurality of tubes aligned to be parallel to each other. Heat is applied to adjacent first end portions of tubes (Continued)

of plurality of tubes and the adjacent first end portions are secured to each other via thermal bond. Heat is applied to adjacent second end portions of the tubes and the adjacent second end portions are secured to each other via thermal bond.

28 Claims, 4 Drawing Sheets

(56) References Cited

U.S. PATENT DOCUMENTS 4,534,068 A * 8/1985 Mitchell ..... A42B 3/124 2/414
4,558,470 A * 12/1985 Mitchell ..... A42B 3/124 2/414
4,630,735 A * 12/1986 Jebens ..... B65D 5/725 229/103.1
5,039,567 A 8/1991 Landi et al.
5,204,998 A 4/1993 Liu
5,840,397 A 11/1998 Landi et al.
6,488,799 B1 12/2002 Court et al.
7,677,538 B2 * 3/2010 Darnell ..... A42B 3/064 267/152
2002/0030115 A1 * 3/2002 Float ..... A47G 21/18 239/33
2002/0184699 A1 12/2002 Ewing et al.
2006/0059605 A1 3/2006 Ferrara
2006/0059606 A1 3/2006 Ferrara
2006/0242752 A1 11/2006 Talluri
2007/0001022 A1 * 1/2007 Chuang ..... A47G 21/187 239/33
2008/0066217 A1 3/2008 Depreitere et al.
2008/0172779 A1 * 7/2008 Ferguson ..... A41D 31/005 2/455
2010/0258988 A1 * 10/2010 Darnell ..... A42B 3/064 267/141
2010/0299812 A1 12/2010 Maddux et al.

* cited by examiner

STRUCTURED MATERIAL FOR IMPACT PROTECTION

This application is a non-provisional which claims the priority of U.S. Provisional Application No. 61/866,807 filed on Aug. 16, 2013. The priority date for this non-provisional application is Aug. 16, 2013.

FEDERAL RESEARCH STATEMENT

This invention was made with government support under contract number W91CRB-11-C-0041 and contract number W911QY-12-C-0120 awarded by the United States Army. The government has certain rights in the invention.

BACKGROUND

The subject matter disclosed herein relates to impact-protection materials. More specifically, the subject matter disclosed herein relates to structured materials that protect against injury to an individual or damage to a structure resulting from one or more impacts by deforming and thereby limiting peak impact forces experienced by the individual or structure.

Impact protection systems, for example, protective headgear, typically include a relatively hard outer shell and a relatively soft inner liner. In the event of an impact by an object to the outer shell, the shell acts to prevent penetration of the object through the headgear and to distribute the impact load over a larger area. The inner liner acts to limit acceleration of the head by (1) absorbing at least a portion of the kinetic energy of the object via deformation of the inner liner, and (2) by modifying the transmitted impulse profile so as to decrease the peak force.

In many headgear designs, the energy absorbing material of the inner liner is an expanded polystyrene material, and a significant mechanism of energy absorption of such a liner is plastic (unrecoverable) deformation and, under high impact loads, fracture of the material upon impact. Previous plastic deformation (e.g., consolidation) and fracture significantly limits the protective effectiveness of the polystyrene material in the case of repeated impacts.

Other headgear configurations utilize viscoelastic foam inner liners, which remain effective after multiple impacts. Viscoelastic foams provide some degree of protection against blunt impact, but the foam microstructure is "isotropic" and the foam responds in a similar manner when loaded along any direction. This may be disadvantageous when it is considered that loading during impact is typically in one primary direction, i.e., compression orthogonal to the outer hard shell surface. The microstructure of viscoelastic foams is not optimized for this predetermined loading direction and thus viscoelastic foam liners do not exhibit an optimal crush efficiency.

Other protective gear configurations utilize polymeric materials formed into a honeycomb structure, which provides a preferred impact response direction along a cell axis. The cells of the honeycomb typically are hexagonal in shape, with each cell wall shared by two adjacent cells. Often such honeycomb materials are formed from thin sheets of material that are bonded at staggered intervals and expanded to form the honeycomb structure.

BRIEF SUMMARY

In an embodiment, a structured material for impact protection includes a plurality of tubular members formed from a thermoplastic elastomer material. The plurality of tubular members are arranged in a bundle such that the central axes of the plurality of tubular members are substantially parallel, and adjacent tubular members are secured to one another along their length.

In another embodiment, a personal protective pad includes an outer shell and a liner assembly disposed between the outer shell and an inner surface of the protective pad and secured to the outer shell. The inner liner includes a plurality of tubular members formed from a thermoplastic elastomer material. The plurality of tubular members are arranged in a bundle such that the central axes of the plurality of tubular members are substantially parallel, and adjacent tubular members are secured to one another along their length.

In yet another embodiment, a protective headgear includes an outer shell and a liner assembly disposed between the outer shell and an inner surface of the headgear and secured to the outer shell. The liner assembly includes a plurality of tubular members formed from a thermoplastic elastomer material. The plurality of tubular members are arranged in a bundle such that the central axes of the plurality of tubular members are substantially parallel. Adjacent tubular members are secured to one another along their length.

In still another embodiment, a method of forming a structured impact protection material includes arranging a plurality of tubes formed from a thermoplastic elastomer material into a selected shape. The tubes are arranged in a layer with central axes of the plurality of tubes aligned to be parallel to each other. Heat is applied to adjacent first end portions of tubes of plurality of tubes and the adjacent first end portions are secured to each other via thermal bond. Heat is applied to adjacent second end portions of the plurality of tubes and the adjacent second end portions are secured to each other via thermal bond. Adjacent middle portions of the plurality of plurality of tubes between the first end portions and the second end portions are movably adjacent to one another.

In another embodiment, a method of forming a structured impact protection material includes arranging a plurality of tubes formed from a thermoplastic elastomer material into a selected bundle shape, the tubes in a layer with central axes of the plurality of tubes aligned to be parallel to each other. Heat is applied to the plurality of tubes so as to thermally bond adjacent tubes to one another along their length. The plurality of tubes are cut along a direction not parallel to the central axes of the plurality of tubes to obtain a layer of bonded tubes These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION

To limit peak forces on impact, especially in repeated impacts, the present disclosure utilizes a structured impact protection material formed from an array of individual tubular elements aligned such that the tubular elements have parallel axes, and joined together at the tube ends to form the impact protection material.

Figure 1:
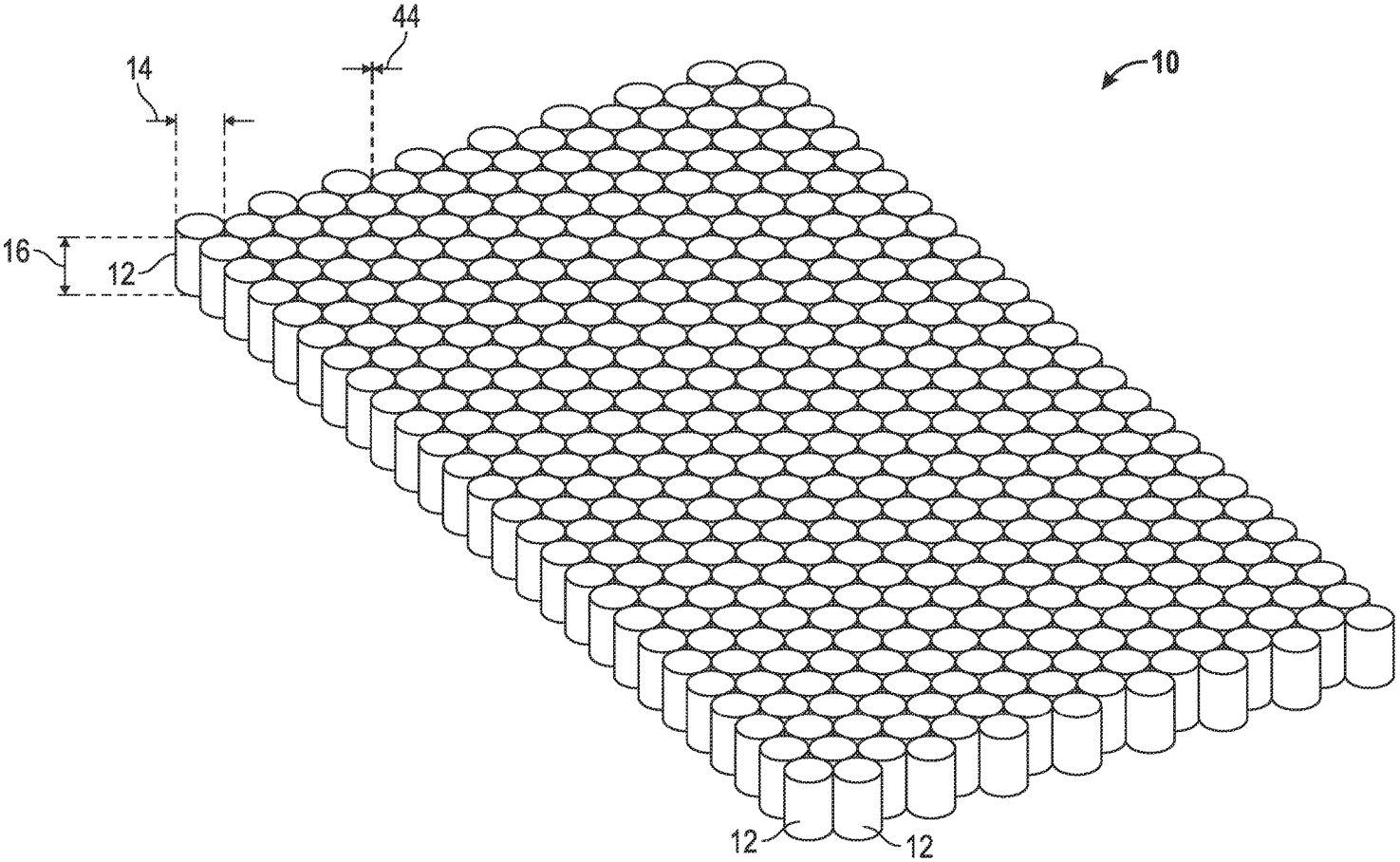
FIG. 1 is a perspective view of an embodiment of a structured impact protection material.
Figure 7:
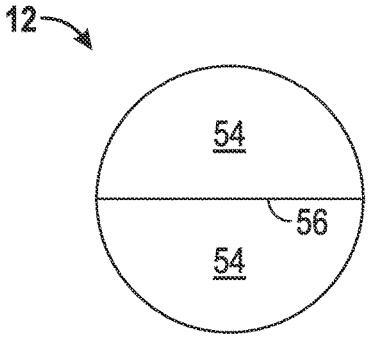
FIG. 7 is a cross-sectional view of an embodiment of a tube.
Figure 8:
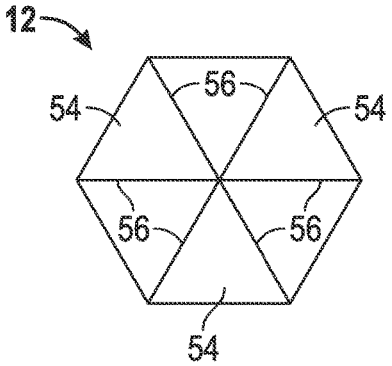
FIG. 8 is a cross-sectional view of another embodiment of a tube.

An embodiment of such an impact protection material 10 is illustrated in FIG. 1. The impact protection material 10 is formed from a plurality of tubular elements, for example, tubes 12. The tubes 12 are hollow and have a curvilinear cross-section. In some embodiments, as shown in FIG. 1, the cross-section is circular or elliptical. In other embodiments the cross-section is not curvilinear, for example, hexagonal, rectangular, triangular or square. Further, in some embodiments, as shown in FIGS. 7 and 8, the tubes 12 are formed with two or more lumens 54, or internal cavities, formed by locating one or more interior walls 56 in the tubes 12. In some embodiments, the impact protection material 10 is formed from tubes 12 having substantially identical cross-sections, while in other embodiments, a combination of different cross sections are utilized to provide selected impact performance characteristics. Further, although the embodiment of FIG. 1 illustrates tubes 12 having a diameter 14 to a length 16 ratio of less than or equal to 1, for example, between about 0.5 and about 0.9, it is to be appreciated that ring elements, having a diameter-to-length ratio greater than 1, may also be utilized to form the impact protection material 10. Further, a diameter 14 to wall thickness 44 ratio of the tubes 12, an indicator of a bulk density of the impact protection material 10, is between about 25 and about 55.

The tubes 12 are formed from a thermoplastic elastomer (TPE), a class of material with both thermoplastic and elastomeric properties. It is understood that the impact protection material 10 may also be referred to as an energy absorbing material. However, not all of the energy imparted on the material 10 via an impact is absorbed by the impact protection material 10. At least a portion of the energy is stored in the impact protection material 10 as elastic energy and is released as the protection material unloads after the impact. In some embodiments, the tubes 12 are formed by extrusion. The tubes 12 may be formed from a single TPE material, or a combination of different TPE materials.

Figure 2:
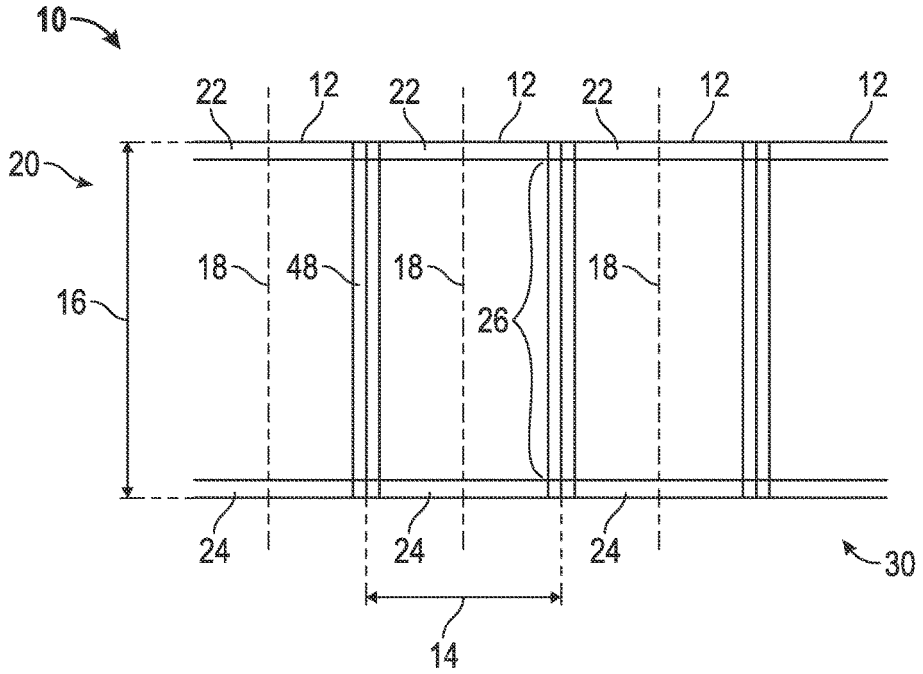
FIG. 2 is a cross-sectional view of an embodiment of a structured impact protection material.

Referring now to the cross-sectional view of FIG. 2, each tube 12 has a tube axis 18 extending parallel to the length 16, and the tubes 12 are arrayed in a single layer 20 with the tube axes 18 of the tubes 12 aligned parallel to one another. Alignment of the tubes 12, with tube axes 18 parallel provides improved dynamic crush characteristics along the tube axis 18 relative to more isotropic materials, such as foams.

In one embodiment, the tubes 12 each have a first end portion 22 and a second end portion 24, opposite the first end portion 22. Adjacent tubes 12 of the layer 20 are joined at the first end portion 22 and the second end portion 24, with a middle portion 26, defined between the first end portion 22 and the second end portion 24 left unjoined to, but abutting adjacent tubes 12. In some embodiments, the middle portion 26 is defined as at least 90% of the length 16. Further, in some embodiments, the middle portion 26 is between about 95% and about 99% of the length 16. The lack of bond between the tubes 12 in the middle portion 26 results in the impact protection material 10 being especially compliant to deformation in a lateral direction not along the tube axis 18. This includes both (1) compliant behavior in lateral compression (where the axis of loading is orthogonal to the tube axis 18) and (2) compliant behavior in transverse shear (where end 22 and end 24 have different displacements along a direction orthogonal to the tube axis 18). Such compliance may be beneficial in a helmet structure for prevention of injury due to head rotation.

In one embodiment, to form the layer 20, the tubes 12 are arranged into a bundle 30 of selected size and shape, with the axes 18 aligned in parallel, either manually or via a machine operation. The adjacent first end portions 22 and second end portions 24 are thermally bonded to secure the first end portions 22 and second end portions 24.

Figure 3:
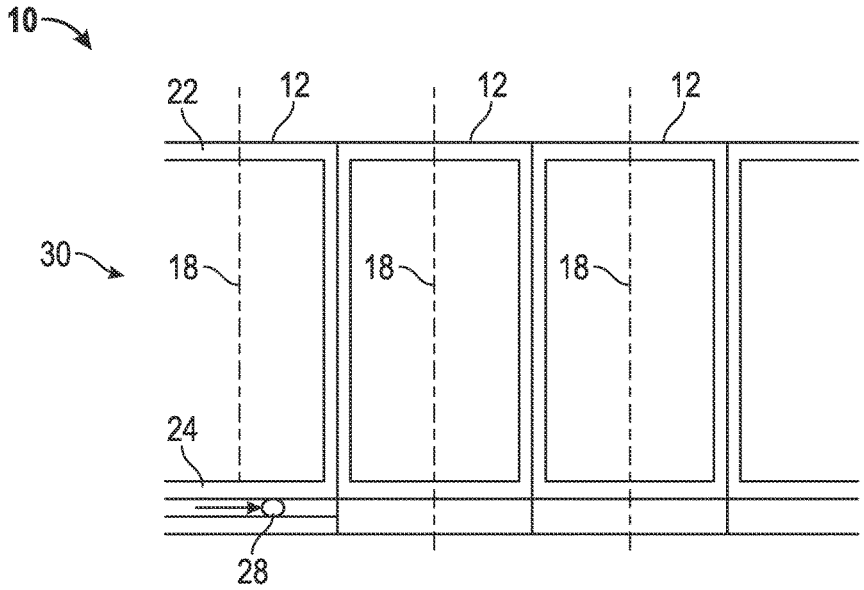
FIG. 3 is a schematic view of an apparatus for forming a structured impact protection material.

The thermal bond of first end portions 22 and second end portions 24 may be achieved via one of several methods. For example, in one embodiment, as shown in FIG. 3, a resistive wire 28 is heated by application of electrical current therethrough, and the heated wire 28 is passed through the bundle 30 nonparallel to the axes 18 to simultaneously cut and heat the first end portions 22 to join the adjacent first end portions 22 by melting and solidification of the first end portions 22. The pass of the wire 28 is repeated to simultaneously cut and heat the second end portions 24 to join the adjacent second end portions 24. In some embodiments, the cutting and heating of the first heads 22 and the second end portions 24 is performed simultaneously. Several factors in the above-described process affect a depth of the sear to the first end portions 22 and the second end portions 24 including, but not limited to, a speed with which the wire 28 is passed through the ends 22, 24, wire 28 thickness and wire 28 temperature.

Figure 4:
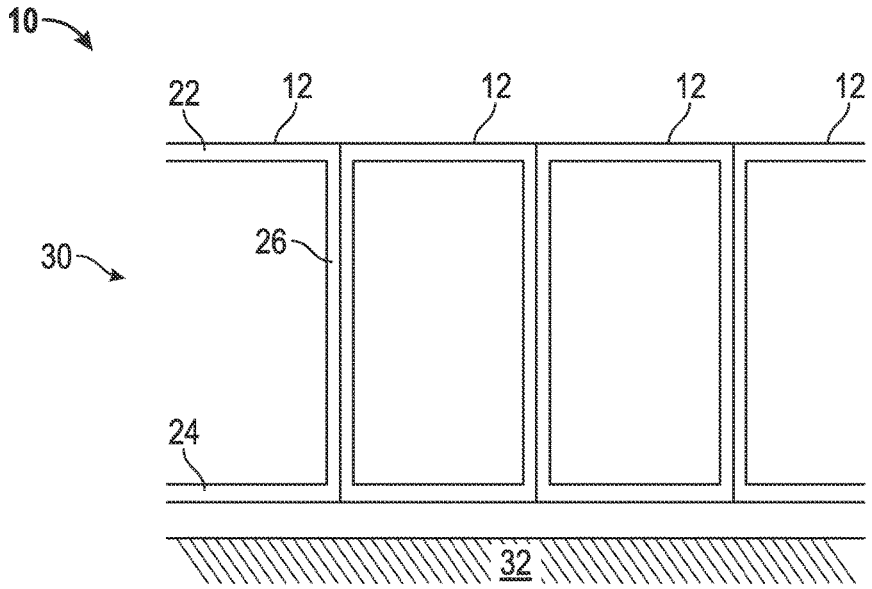
FIG. 4 is a schematic view of another embodiment of an apparatus for forming a structured impact protection material.

In another embodiment, as shown in FIG. 4, a hot plate 32 is applied to the bundle 30 to sear the first end portions 22 and to sear the second end portions 24, thus joining them. The hot plate 32 may be pressed into the bundle 30 to increase the depth of the sear, depending on a selected length of the middle portion 26, thus altering the stiffness of the bundle 30, as an increased depth of the sear will increase the stiffness.

Alternatively or additionally, multiple tubes 12 of bundle 30 are formed simultaneously by extrusion, with a residual tackiness of the tubes 12 from the extrusion process allowing adjacent tubes 12 to adhere or bond to one another along the middle portion 26. This bonding along the middle portion 26 is in addition to, or instead of, the thermal bonding of the ends 22, 24. Further, in other embodiments, after bonding of the first end portions 22 and second end portions 24 is achieved, the bundle 30 is heated to increase tackiness of the middle portion 26, resulting in adhesion or bonding of the adjacent middle portions 26 to one another. A selected cross-sectional shape of the bundle 30 is achieved by packing the bundle into a form having the selected cross-sectional shape, or alternatively by forming the bundle 30 larger than the selected cross-sectional shape, then trimming the bundle 30 to the selected shape after searing the bundle 30. In some embodiments, the trimming is achieved by die-cutting.

In another embodiment, adjacent tubes 12 are thermally bonded to one another along their length through application of heat to a bundle 30 of tubes 12 of selected shape. The bonded tube bundle 30 is then cut in a direction not along tube axes 18 to form layers 20. The presence of a bond between the tubes 12 along their length results in the impact protection material 10 being both stiffer and stronger than it otherwise would be if the tubes 12 were not bonded along their middle portion 26. In this embodiment, protection material 10 will not be as compliant in the lateral direction as it otherwise would have been if the middle portions 26 of adjacent tubes 12 were left unbonded.

Figure 5:
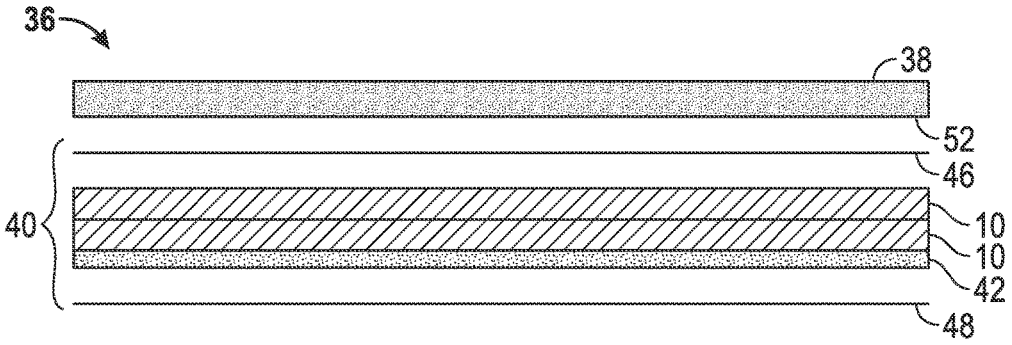
FIG. 5 is a cross-sectional view of an embodiment of a protective headgear.

Referring to FIG. 5, the impact protection material 10 may be used, for example, as a component of a liner assembly 40 for a protective helmet 36. The helmet 36 includes an outer shell 38 with the liner assembly 40 affixed to the outer shell 38 so as to be positioned between the outer shell 38 and the wearer (not shown) of the helmet 36. The liner assembly 40 includes one or more layers of impact protection material 10 stacked along tube axes 18. In the embodiment of FIG. 5, two layers of impact protection material 10 are utilized, but it is to be appreciated that other quantities of layers, such as 1, 3, or 4 layers may be used. An inner layer 42 of, for example, a viscoelastic foam, is positioned between the layers of impact protection material 10 and the wearer. The inner layer 42 is included because it is very compliant at low strain rates, and therefore provides comfort to the wearer when it is compressed to fit against the wearer's head. The inner layer 42 is stiffer and stronger at high strain rates, thus contributing to limiting peak forces and head accelerations at impact. In some embodiments, a gas-filled bladder and/or a gel-filled bladder are utilized as the inner layer 42. Further, in some embodiments, at least some of the tubes 12 are filled with a material, for example, microspheres, foam beads or gel, to tune the impact absorption properties of the tubes 12. In yet other embodiments, the tubes 12 are sealed by, for example, applying a cover sheet to each tube end, thus capturing a volume of air in each tube to aid in impact protection. In some embodiments, an orifice in, for example, the cover sheet, is included to control a rate of air release from the tubes 12 upon impact.

An outer covering layer 46 is positioned between the impact protection material 10 and the outer shell 38 and an inner covering layer 48 is positioned between the inner layer 42 and the wearer. The outer covering layer 46 and the inner covering layer 48 are formed from, for example, a fabric or plastic material and are bonded together by, for example, RF welding, or other means such as stitching, to contain the impact protection material 10 and the inner layer 42 therebetween. In some embodiments, the inner covering layer 48 and the outer covering layer 46 may be formed into a unitary cover sleeve into which the impact protection material 10 and the inner layer are inserted.

The liner assembly 40 is then secured to the outer shell 38. In some embodiments, the outer covering layer 46 is formed from a loop fabric securable to a hook material 52 which is in turn fastened to the inside of the outer shell 38. In other embodiments, the liner assembly 40 is secured to the outer shell 38 by other means, for example, adhesive.

Figure 6:
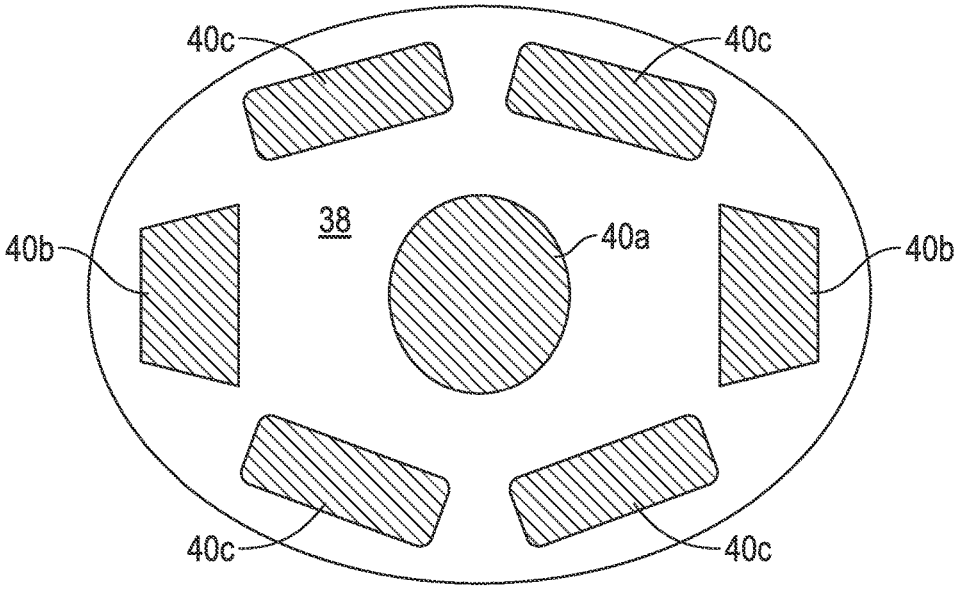
FIG. 6 is a plan view of a liner pad arrangement for a protective headgear.

Referring now to FIG. 6, in some embodiments, a plurality of liner assemblies 40 are secured to the outer shell 38 at selected positions. For example, an array of one round liner assembly 40*a*, two trapezoidal liner assemblies 40*b* and 4 oval liner assemblies 40*c* are positioned at selected locations in the outer shell 38.

While the above description is applied to a protective helmet 36, it is to be appreciated that the impact protection material 10 may be utilized as part of other wearable personal protective structures such as shin guards, thigh pads, shoulder pads, or the like. Further, the impact protection material may be utilized in non-wearable personal protective structures such as seat backs and other interior structures in vehicles. Further, the impact protection material 10 may be utilized in other applications such as flooring, packaging, or the like.

In an embodiment, a structured material for impact protection comprises a plurality of tubular members formed from a thermoplastic elastomer material. The plurality of tubular members are arranged in a bundle such that the central axes of the plurality of tubular members are substantially parallel, and adjacent tubular members are secured to one another along their length.

In another embodiment, a personal protective pad comprises an outer shell and a liner assembly disposed between the outer shell and an inner surface of the protective pad and secured to the outer shell. The inner liner includes a plurality of tubular members formed from a thermoplastic elastomer material. The plurality of tubular members are arranged in a bundle such that the central axes of the plurality of tubular members are substantially parallel, and adjacent tubular members are secured to one another along their length.

In yet another embodiment, a protective headgear comprises an outer shell and a liner assembly disposed between the outer shell and an inner surface of the headgear and secured to the outer shell. The liner assembly includes a plurality of tubular members formed from a thermoplastic elastomer material. The plurality of tubular members are arranged in a bundle such that the central axes of the plurality of tubular members are substantially parallel. Adjacent tubular members are secured to one another along their length.

In still another embodiment, a method of forming a structured impact protection material comprises arranging a plurality of tubes formed from a thermoplastic elastomer material into a selected shape. The tubes are arranged in a layer with central axes of the plurality of tubes aligned to be parallel to each other. Heat is applied to adjacent first end portions of tubes of plurality of tubes and the adjacent first end portions are secured to each other via thermal bond. Heat is applied to adjacent second end portions of the plurality of tubes and the adjacent second end portions are secured to each other via thermal bond. Adjacent middle portions of the plurality of plurality of tubes between the first end portions and the second end portions are movably adjacent to one another.

In another embodiment, a method of forming a structured impact protection material comprises arranging a plurality of tubes formed from a thermoplastic elastomer material into a selected bundle shape, the tubes in a layer with central axes of the plurality of tubes aligned to be parallel to each other. Heat is applied to the plurality of tubes so as to thermally bond adjacent tubes to one another along their length. The plurality of tubes are cut along a direction not parallel to the central axes of the plurality of tubes to obtain a layer of bonded tubes In the various embodiments, (i) each tubular member includes a first end portion located along a central axis of the tubular member, a second end portion opposite the first end portion and a middle portion located along the central axis between the first end portion and the second end portion, with adjacent first end portions of adjacent tubular members of the plurality of tubular members secured to one another, adjacent second end portions of adjacent tubular members of the plurality of tubular members secured to one another, and adjacent middle portions of adjacent tubular members are movably adjacent to one another; and/or (ii) the first end portion comprises up to 5% of a tube length; and/or (iii) the middle portion comprises at least 90% of a tube length; and/or (iv) the adjacent middle portions of adjacent tubular members are secured to one another; and/or (v) the tubular members are secured to one another via a thermal bond; and/or (vi) a tubular member of the plurality of tubular members has a circular cross section; and/or (vii) a tubular member of the plurality of tubular members has a cross section that is one of oval, hexagonal, rectangular or triangular; and/or (viii) a tubular member of the plurality of tubular members includes two or more internal cavities; and/or (ix) a tubular member of the plurality of tubular members has a tube diameter to tube length ratio of less than 1; and/or (x) the tube diameter to tube length ratio is between about 0.5 and about 0.9; and/or (xi) a tubular member of the plurality of tubular members has a tube diameter to tube wall thickness ratio between about 25 and about 55; and/or (xii) the plurality of tubular members are arranged in two or more tube layers; and/or (xiii) further includes an inner layer adjacent to the plurality of tubular members; and/or (xiv) the inner layer is one of a foam, a gel-filled bladder, or a gas-filled bladder, or a combination thereof; and/or (xv) a cover at least partially encloses the liner assembly; and/or (xvi) the liner assembly is secured to the outer shell via a hook and loop fastener.

The term "About" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A structured material for impact protection comprising:
a plurality of tubular members formed from a thermoplastic elastomer material;
wherein the plurality of tubular members are arranged in a bundle such that the central axes of the plurality of tubular members are substantially parallel;
wherein adjacent tubular members abut one another along their length;
wherein each tubular member includes:
a first end portion located along a central axis of the tubular member;
a second end portion opposite the first end portion; and
a middle portion located along the central axis between the first end portion and the second end portion;
wherein:
adjacent first end portions of adjacent tubular members of the plurality of tubular members are secured to one another;
adjacent second end portions of adjacent tubular members of the plurality of tubular members are secured to one another; and
adjacent middle portions of adjacent tubular members are movably adjacent to one another.

2. The structured material of claim 1, wherein the first end portion comprises up to 5% of a tube length.

3. The structured material of claim 1, wherein the middle portion comprises at least 90% of a tube length.

4. The structured material of claim 1, wherein the adjacent middle portions of adjacent tubular members are secured to one another.

5. The structured material of claim 1, wherein the tubular members are secured to one another via a thermal bond.

6. The structured material of claim 1, wherein a tubular member of the plurality of tubular members has a circular cross section.

7. The structured material of claim 1, wherein a tubular member of the plurality of tubular members has a cross section that is one of oval, hexagonal, rectangular or triangular.

8. The structured material of claim 1, wherein a tubular member of the plurality of tubular members includes two or more internal cavities.

9. The structured material of claim 1, wherein a tubular member of the plurality of tubular members has a tube diameter to tube length ratio of less than 1.

10. The structured material of claim 9, wherein the tube diameter to tube length ratio is between 0.5 and 0.9.

11. The structured material of claim 1, wherein a tubular member of the plurality of tubular members has a tube diameter to tube wall thickness ratio between 25 and 55.

12. The structured material of claim 1, wherein the plurality of tubular members are arranged in two or more tube layers.

13. A personal protective pad comprising:
an outer shell; and
a liner assembly disposed between the outer shell and an inner surface of the protective pad and secured to the outer shell including:
a plurality of tubular members formed from a thermoplastic elastomer material;
wherein the plurality of tubular members are arranged in a bundle such that the central axes of the plurality of tubular members are substantially parallel; and
wherein adjacent tubular members abut one another along their length.

14. The personal protective pad of claim 13, wherein each tubular member includes:
a first end portion located along a central axis of the tubular member;
a second end portion opposite the first end portion; and
a middle portion located along the central axis between the first end portion and the second end portion;
wherein:
adjacent first end portions of adjacent tubular members of the plurality of tubular members are secured to one another;
adjacent second end portions of adjacent tubular members of the plurality of tubular members are secured to one another; and adjacent middle portions of adjacent tubular members are movably adjacent to one another.

15. The personal protective pad of claim 13, wherein the tubular members are secured to one another via a thermal bond.

16. The personal protective pad of claim 13, further comprising an inner layer adjacent to the plurality of tubular members.

17. The personal protective pad of claim 13, wherein the inner layer is one of a foam, a gel-filled bladder, or a gas-filled bladder, or a combination thereof.

18. A protective headgear comprising:

an outer shell; and a liner assembly disposed between the outer shell and an inner surface of the headgear and secured to the outer shell including:

a plurality of tubular members formed from a thermoplastic elastomer material;

wherein the plurality of tubular members are arranged in a bundle such that the central axes of the plurality of tubular members are substantially parallel; and wherein adjacent tubular members abut one another along their length.

19. The protective headgear of claim 18, wherein each tubular member includes:

a first end portion located along a central axis of the tubular member;

a second end portion opposite the first end portion; and a middle portion located along the central axis between the first end portion and the second end portion;

wherein:

adjacent first end portions of adjacent tubular members of the plurality of tubular members are secured to one another;

adjacent second end portions of adjacent tubular members of the plurality of tubular members are secured to one another; and adjacent middle portions of adjacent tubular members are movably adjacent to one another.

20. The headgear of claim 19, wherein the first end portion comprises up to 5% of a tube length.

21. The headgear of claim 19, wherein the middle portion comprises at least 90% of a tube length.

22. The headgear of claim 18, wherein the tubular members are secured to one another via a thermal bond.

23. The headgear of claim 18, wherein the plurality of tubular members are arranged in two or more tube layers.

24. The headgear of claim 18, wherein the liner assembly further includes an inner layer disposed on an inner surface of the plurality of tubes.

25. The headgear of claim 18, wherein the inner layer is one of a foam, a gel-filled bladder, or a gas-filled bladder.

26. The headgear of claim 18, further comprising a cover at least partially enclosing the liner assembly.

27. The headgear of claim 18, wherein the liner assembly is secured to the outer shell via a hook and loop fastener.

28. The headgear of claim 18, wherein a tube of the plurality of tubes is filled with one of a gel, microspheres or foam beads.

* * * * *